US005957116A

United States Patent [19]

Haegele et al.

[11] Patent Number: 5,957,116

[45] Date of Patent: Sep. 28, 1999

[54] INTEGRATED AND SEPARABLE EGR DISTRIBUTION MANIFOLD

[75] Inventors: Glen T. Haegele; Paul R. Miller; Long Kung Hwang, all of Columbus, Ind.

[73] Assignee: Cummins Engine Company, Inc., Columbus, Ind.

[21] Appl. No.: 08/919,462

[22] Filed: Aug. 28, 1997

[51] Int. Cl.[6] ..... F02M 25/07

[52] U.S. Cl. ..... 123/568.12; 123/568.17

[58] Field of Search ..... 123/568.12, 568.17

[56] References Cited

U.S. PATENT DOCUMENTS

| | | | |
|---|---|---|---|
| 2,633,837 | 4/1953 | Godfrey | 123/568.17 |
| 3,710,770 | 1/1973 | Newkirk et al. | 123/568.17 |
| 3,866,586 | 2/1975 | Scott, Jr. | 123/568.17 |
| 4,445,487 | 5/1984 | Higashi | 123/568.17 |
| 4,461,150 | 7/1984 | Grohm | 123/568.17 |
| 5,207,714 | 5/1993 | Hayashi et al. | 123/568.17 |

*Primary Examiner*—Tony M. Argenbright
*Assistant Examiner*—Arnold Castro
*Attorney, Agent, or Firm*—Woodard, Emhardt, Naughton, Moriarty & McNett

[57] ABSTRACT

An exhaust gas recirculation (EGR) manifold received within an intake manifold. The EGR manifold includes a plurality of holes for delivery of recirculated exhaust gas within the flowpath of the intake manifold. Both linear and round shapes are contemplated for the EGR manifold.

35 Claims, 10 Drawing Sheets

INTEGRATED AND SEPARABLE EGR DISTRIBUTION MANIFOLD

BACKGROUND OF THE INVENTION

The present invention relates to improvements in exhaust gas recirculation manifolds for internal combustion engines, although some applications may be outside of this field.

Since the mid 1970s, it has been appreciated that the recirculation of exhaust gas into the inducted air of the intake manifold produces certain benefits in terms of reduced emissions. Typically, a small amount of exhaust gas is taken from the exhaust manifold, passed in appropriate plumbing to a controlling component such as a valve, and then introduced through a fitting into the intake manifold. Various designs relate to this area, including:

| Patent No. | Patentee | Issue Date |
|---|---|---|
| 5,490,488 | Aversa et al. | 2/13/96 |
| 4,870,941 | Hisatomi | 10/3/89 |
| 4,072,133 | McWhirter | 2/7/78 |
| 5,490,488 | Aversa et al. | 2/13/96 |
| 3,717,130 | Thornburgh | 2/20/73 |
| 3,717,131 | Chana et al. | 2/20/73 |
| 5,492,104 | Elder et al. | 2/20/96 |
| 5,609,144 | Seizew et al. | 3/11/97 |
| 3,892,026 | Thornburgh | 7/1/75 |
| 5,425,347 | Zinke, II | 6/20/95 |
| 5,542,711 | Vaudry | 8/6/96 |
| 5,329,912 | Matsumoto et al. | 7/19/94 |
| 4,609,009 | Tisone | 9/2/86 |
| 2,034,144 | Lauret | 3/17/86 |
| 5,427,080 | Maeda et al. | 6/27/95 |
| 4,276,865 | Hamai | 7/7/81 |
| 5,474,102 | Lopez | 12/12/95 |

Many of these designs tend to produce less than adequate distribution of recirculated exhaust gas among multiple cylinders, especially when there is a single entry point for the recirculated exhaust gas, or when the recirculated exhaust gas is cooled or introduced in large flow rates. Cooling of the exhaust gas results in another problem of condensation of an acidic and corrosive mixture.

What is needed is an improved exhaust gas recirculation (EGR) manifold, which the present invention proposes in a novel and unobvious way.

SUMMARY OF THE INVENTION

One aspect of the present invention provides an apparatus for an internal combustion engine comprising an intake manifold and a removable exhaust gas recirculation manifold. The intake manifold includes a cavity for receiving the exhaust gas recirculation manifold. The exhaust gas recirculation (EGR) manifold is insertable in the cavity of the intake manifold. The EGR manifold defines a plurality of holes for delivery of exhaust gas to the intake manifold. In another aspect of the present invention the EGR manifold is removable from the intake manifold without the need to detach the intake manifold from the engine.

One object of the present invention is to provide an improved EGR manifold for an internal combustion engine. Related objects of the present invention will be apparent from the Description of the Preferred Embodiment.

DESCRIPTION OF THE PREFERRED EMBODIMENT

Figure 1:
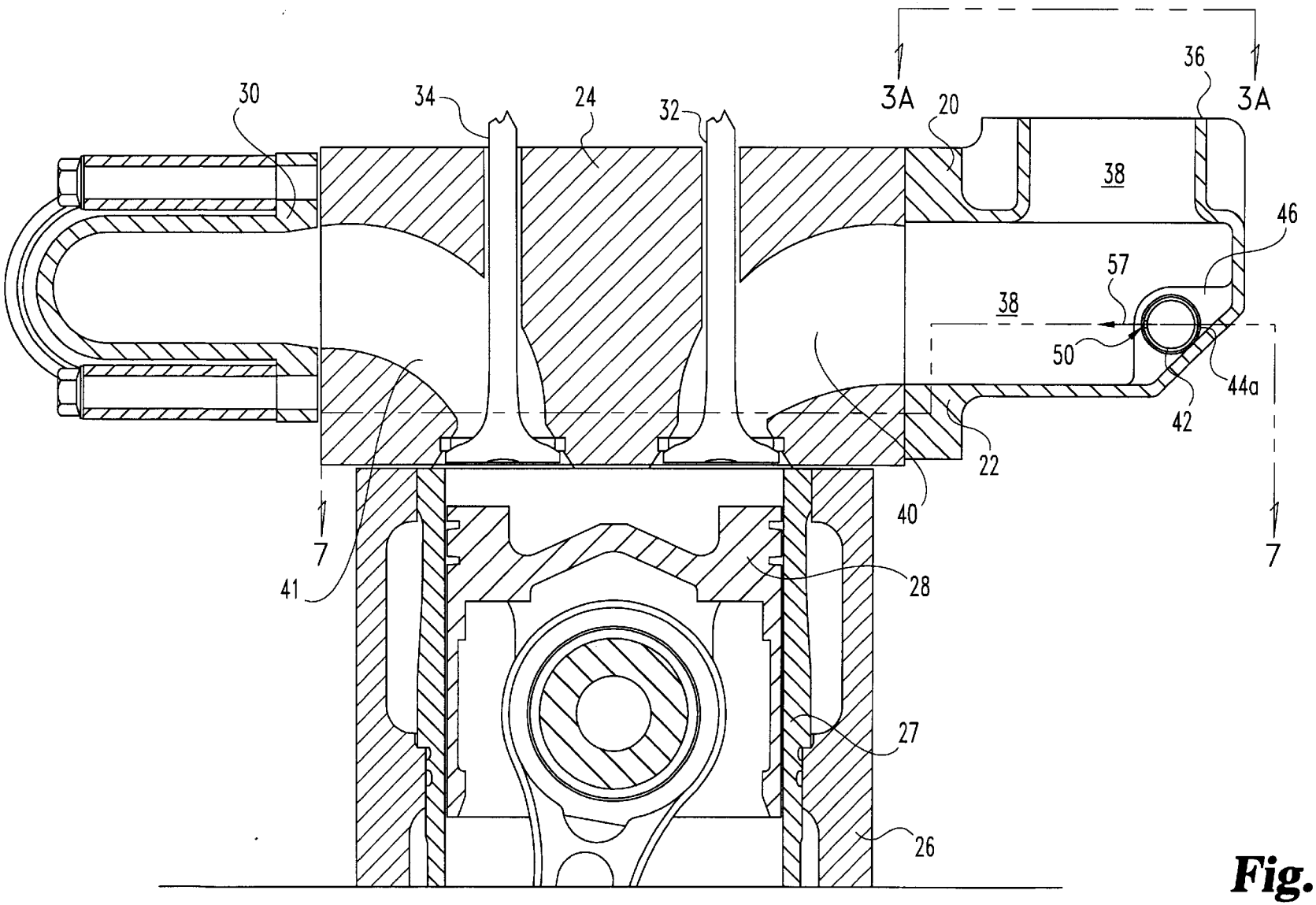
FIG. 1 is a cross sectional, front elevational view of an internal combustion engine incorporating a first embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

FIG. 1 is a cross sectional, front elevational view of an internal combustion engine incorporating a first embodiment of the present invention. A cast intake manifold 20 is shown attached through attachment boss 22 to a cylinder head 24 of the engine. Head 24 is attached to an engine block 26 that includes one or more cylinders 27. A piston assembly 28 is located in each cylinder 27. Also attached to head 24 is exhaust manifold 30. Intake valve 32 and exhaust valve 34 permit supply and removal respectively, of a gaseous mixture into cylinder 27.

Intake manifold 20 incorporates an inlet 36 through which inducted air is provided. This mixture flows into internal flowpath 38 of manifold 20 and into intake port 40 when intake valve 32 is open. The mixture is combusted within cylinder 27, and flows as exhaust gas into exhaust port 41 and into exhaust manifold 30 when exhaust valve 34 is open. A portion of this exhaust gas is provided in a manner not shown to a separable and removable exhaust gas recirculation (EGR) manifold 42 received within first cavity 44*a* of intake manifold boss 46, providing recirculated exhaust gas for mixing with the inducted air within flowpath 38.

Figure 2A:
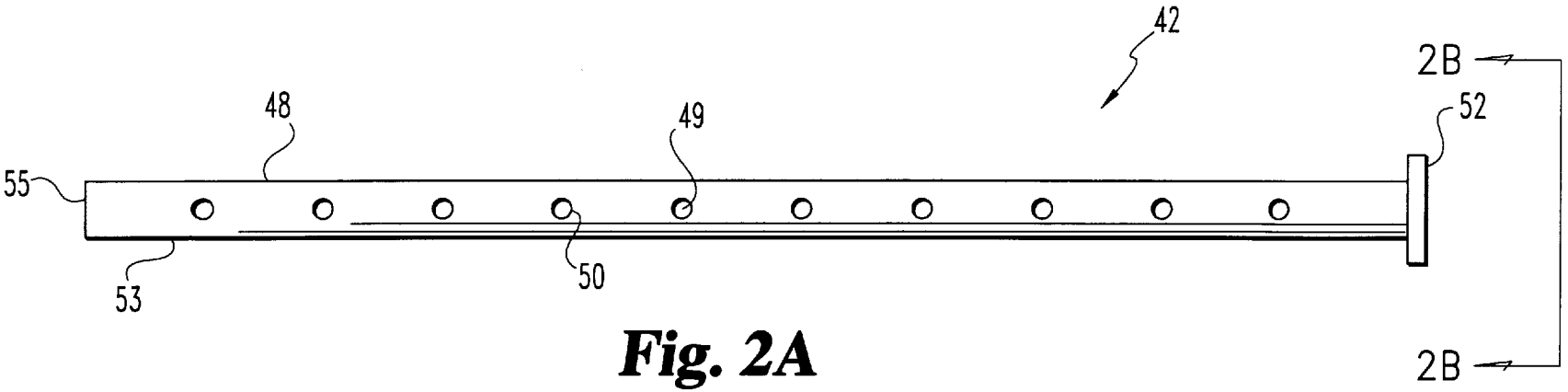
FIG. 2A is a side elevational view of an exhaust gas recirculation manifold of the first embodiment of the present invention.
Figure 2B:
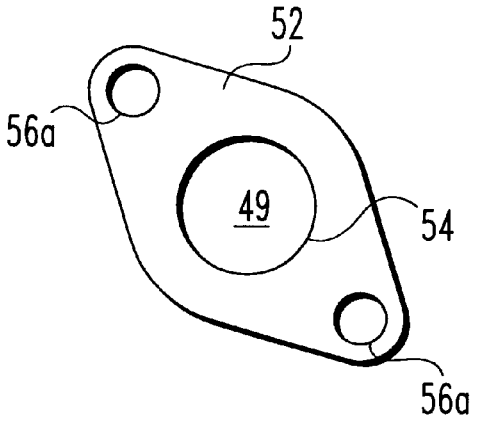
FIG. 2B is a left end elevational view of the FIG. 2A manifold as taken along line 2B—2B in FIG. 2A.

FIG. 2A is a side elevational view of the exhaust gas recirculation manifold of the first embodiment of the present invention. EGR manifold 42 includes a hollow, generally cylindrical body 48 defining internal volume 49 and incorporating a plurality of outlet holes 50. Exhaust gas flows into internal volume 49 which is in fluid communication with delivery holes 50. EGR manifold 42 incorporates flange 52 which defines inlet 54 of body 48, as shown in FIG. 2B. A pair of holes 56*a* in flange 52 are useful for fastening of EGR manifold 42 to intake manifold 20. End 53 of EGR manifold 42 incorporates a second inlet 55 that is in fluid communication with internal volume 49. Recirculated exhaust gas generally flows as indicated by arrow 57 (See FIG. 1).

Figure 3A:
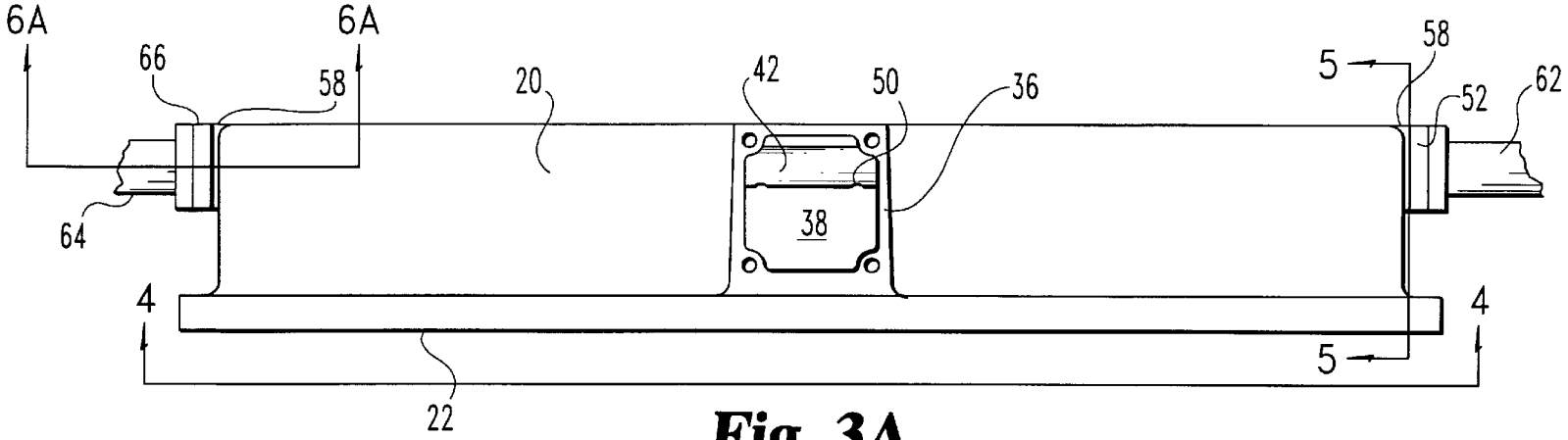
FIG. 3A is a top plan view of the FIG. 1 engine as taken along line 3A—3A in FIG. 1.

FIG. 3A is a top plan view of the FIG. 1 engine as taken along line 3A—3A in FIG. 1. The assembly includes EGR manifold 42 which has been inserted within intake manifold 20, with a first supply of exhaust gas delivered via conduit 62 and a second supply of exhaust gas delivered via conduit 64 to different ends of intake manifold 20. First conduit 62 is attached to a flange boss 58 of manifold 20 through flange 52 of EGR manifold 42, and is in fluid communication with inlet 54. The second conduit 64 is attached to another flange boss 58 of manifold 20 through flange fitting 66 and is in fluid communication with inlet 55. The present invention is useful for exhaust gas recirculation systems in which one of the supply conduits 62 or 64 provides exhaust gas that is essentially uncooled, and the other supply provides exhaust gas that is cooled through a heat exchanger (not shown). The cooled supply is typically at least 100 degrees Fahrenheit cooler than the uncooled supply.

Figure 3B:
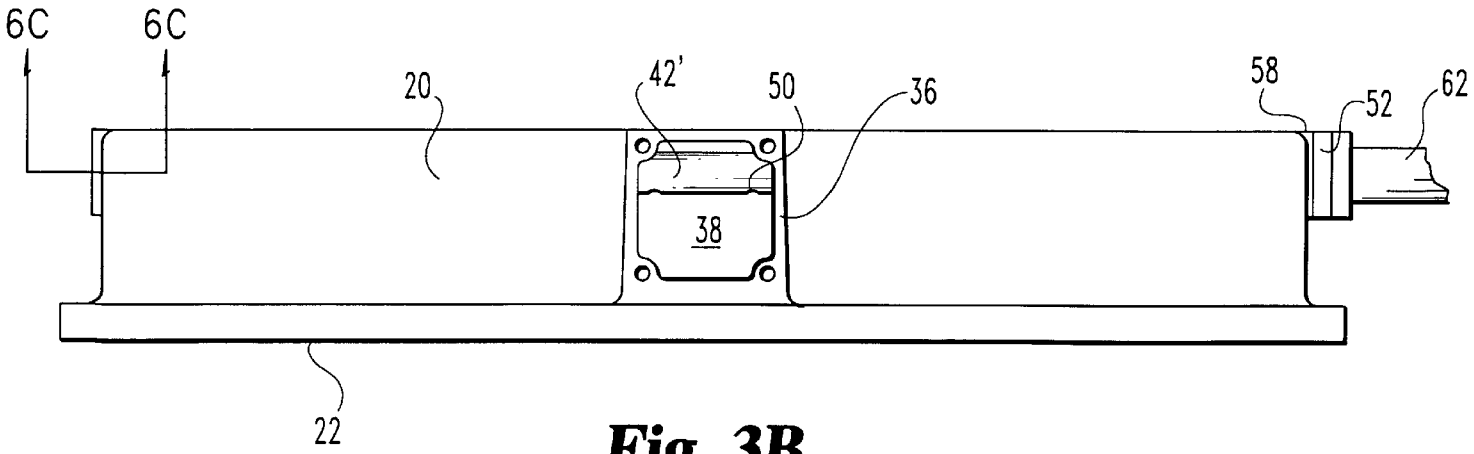
FIG. 3B is a top plan view of the FIG. 1 engine as taken along line 3A—3A in FIG. 1, with alternative EGR manifold 42' installed.

The present invention also contemplates an alternative intake manifold assembly which incorporates EGR manifold 42' in place of EGR manifold 42 as shown in FIG. 3B. EGR manifold 42' has a single inlet 54 for exhaust gas, with end 53' being closed. The present invention contemplates that single inlet 52' can be in fluid communication with a single exhaust gas supply conduit 62 or 64, or as another alternative, single inlet 52' can be in fluid communication with a controlling device such as a valve that can alternately provide exhaust gas from either supply conduit 62 or 64.

Figure 4:
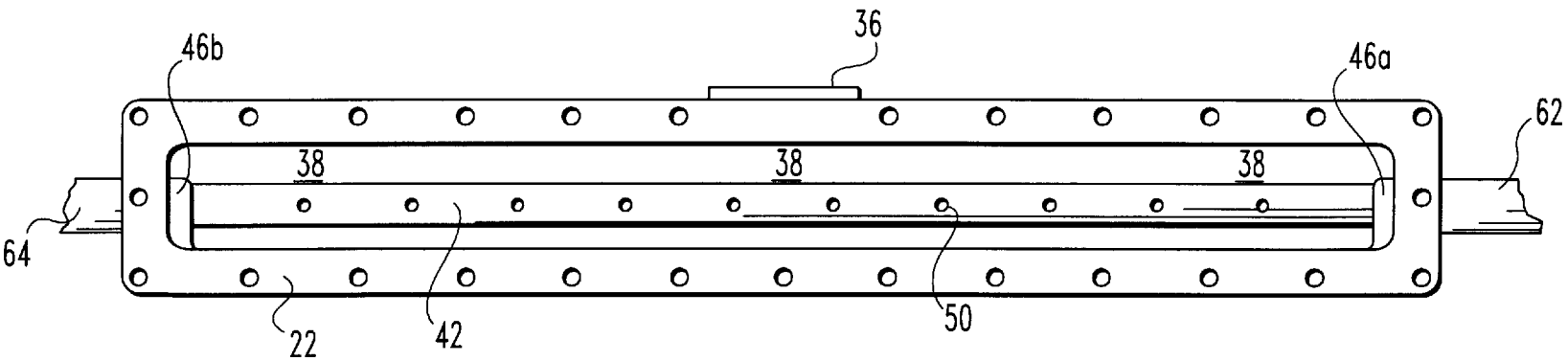
FIG. 4 is a side elevational view of the FIG. 3 assembly as taken along line 4—4 in FIG. 3A.

FIG. 4 is a side elevational view of the FIG. 3 assembly as taken along line 4—4 in FIG. 3A. EGR manifold 42 is supported by flange bosses 58 and received within cavities 44*a* and 44*b* of support bosses 46*a* and 46*b*, respectively, of intake manifold 20. It is preferable that support bosses 46*a* and 46*b* be cast integrally into intake manifold 20, although separately attachable support bosses are within the scope of the present invention. Flange bosses 58 are of a conventional two fastener variety, though the present invention contemplates other methods of supporting EGR manifold 42. For example, one or more support bosses 46 could support manifold 42 along its length and intermediate of its ends.

It is preferable but not necessary that the means for supporting manifold 42 be compatible with the casting of intake manifold 20 in a casting tool that has received within it the EGR manifold prior to casting. It is preferable that the means for supporting manifold 42 allow for differential thermal growth between manifolds 42 and 20. The present invention contemplates fabrication of an exhaust gas recirculation manifold that is fabricated from a material different than the material of the intake manifold. In addition, the EGR manifold may be at a temperature different than the intake manifold. The difference in materials and temperatures may result in one manifold expanding or contracting a different amount than the other. Those of ordinary skill in the art understand various attachment methods for accommodating differential thermal growth.

Figure 5:
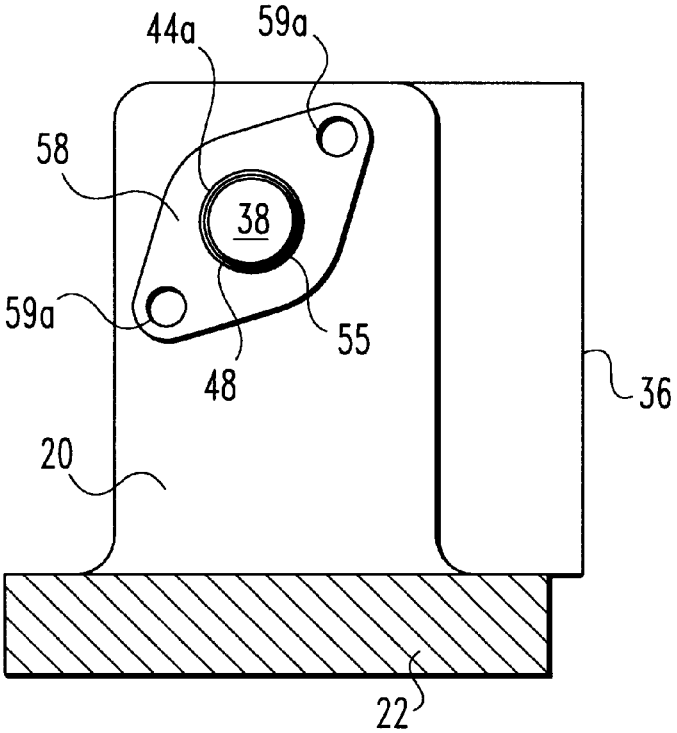
FIG. 5 is an end elevational view of the FIG. 3 assembly as taken along line 5—5 in FIG. 3A.

FIG. 5 is an end elevational view of the FIG. 3 assembly as taken along line 5—5 in FIG. 3A. A flange boss 58 is cast integrally into intake manifold 20. The surface of flange boss 58 is generally flat. A pair of blind fastener holes 59*a* located within boss 58 are generally aligned with holes 56*a* of flange 52. The surface of flange boss 58 is generally perpendicular to cavity 44*a* which receives one end of EGR manifold 42.

Figure 6A:
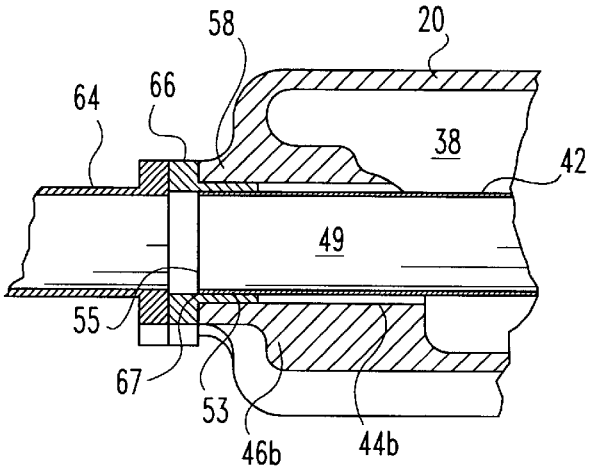
FIG. 6A is a cross sectional view of a portion of the FIG. 3A assembly as taken along line 6A—6A in FIG. 3A.
Figure 6B:
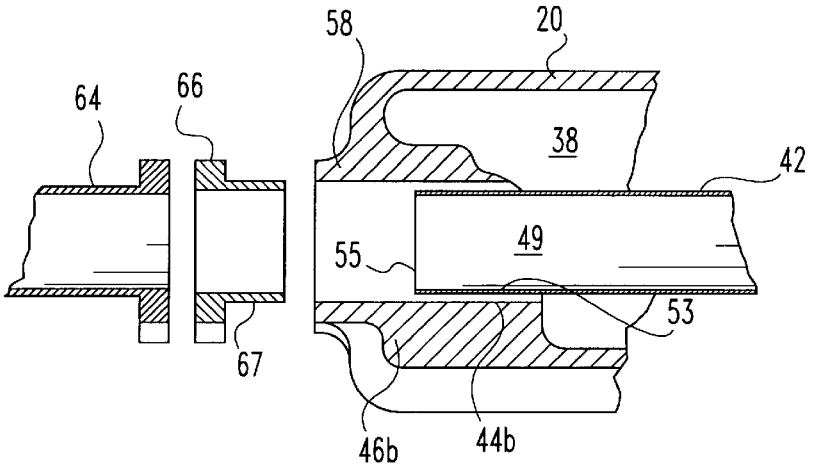
FIG. 6B is an exploded view of the portion of the FIG. 3A assembly shown in FIG. 6A.
Figure 6C:
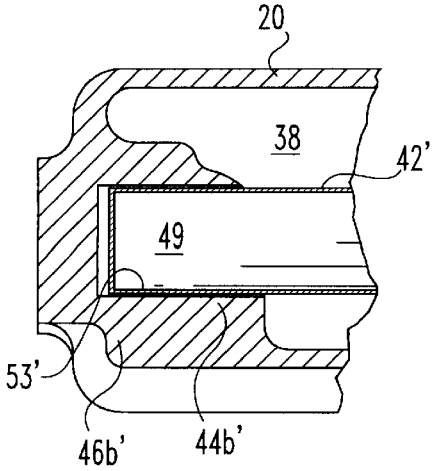
FIG. 6C is a cross sectional view of a portion of the FIG. 3B assembly as taken along line 6C—6C in FIG. 3B, with alternative EGR manifold 42' installed.

FIG. 6A is a cross sectional view of a portion of the FIG. 3A assembly as taken along line 6A—6A in FIG. 3A. FIG. 6B is an exploded view of the portion of the FIG. 3A assembly shown in FIG. 6A. A flange fitting 66 is shown in contact with intake manifold 20. Fitting 66 includes a flange generally in the shape of boss 58. Fitting 66 also includes a short cylindrical section 67 received within second cavity 44*b*. End 53 of EGR manifold 42 slidably fits within the inner diameter of section 67. End 53 is supported by cavity 44*b* through section 67. Differential thermal growth between intake manifold 20 and EGR manifold 42 is accommodated by sliding of end 53 within section 67. Second supply of exhaust gas 64 is attached to boss 58 through flange fitting 66. Exhaust gas is thus presented to second inlet 55 of EGR manifold 42. Alternative EGR manifold 42' includes a boss 46*b*' with a blind cylindrical cavity 44*b*' for slidably supporting closed end 53' as shown in FIG. 6C.

Figure 7A:
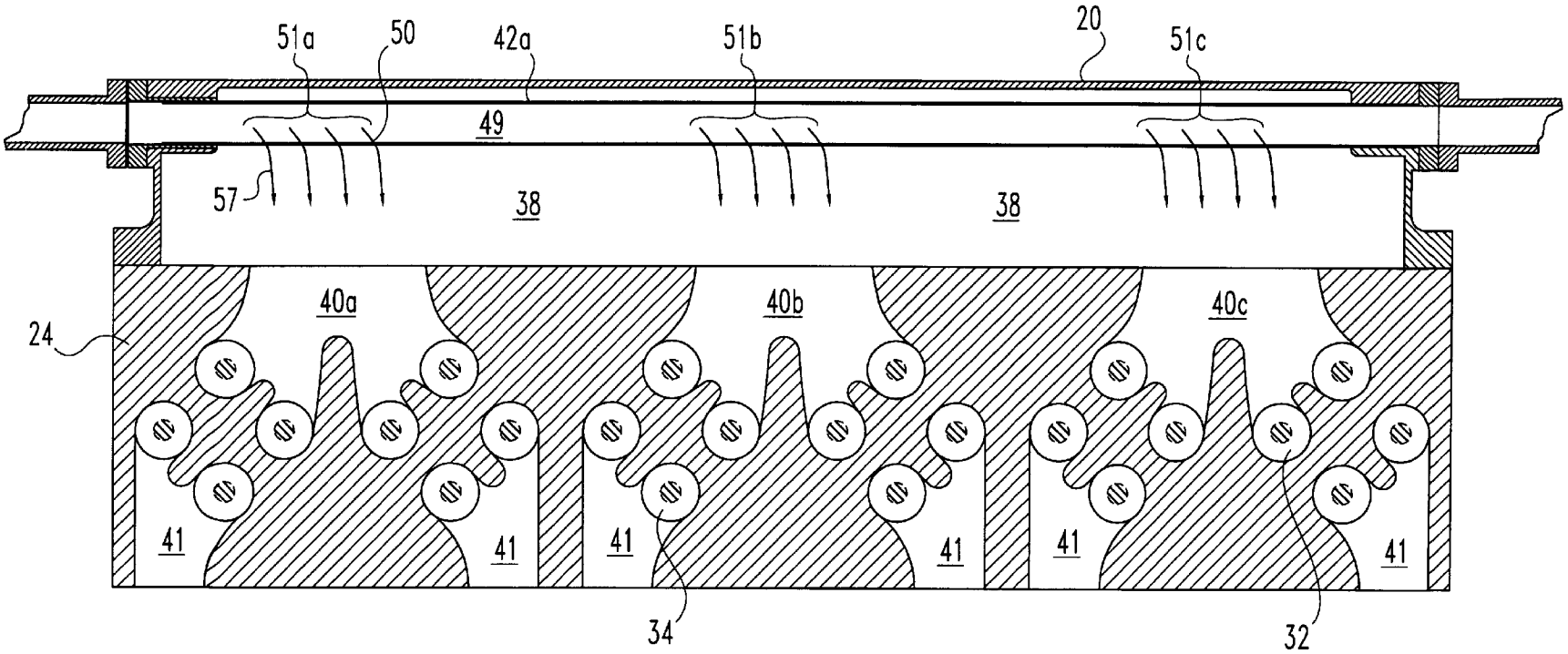
FIG. 7A is a cross sectional view of the FIG. 1 engine as taken along line 7—7 in FIG. 1, with alternative EGR manifold 42*a* installed.
Figure 7B:
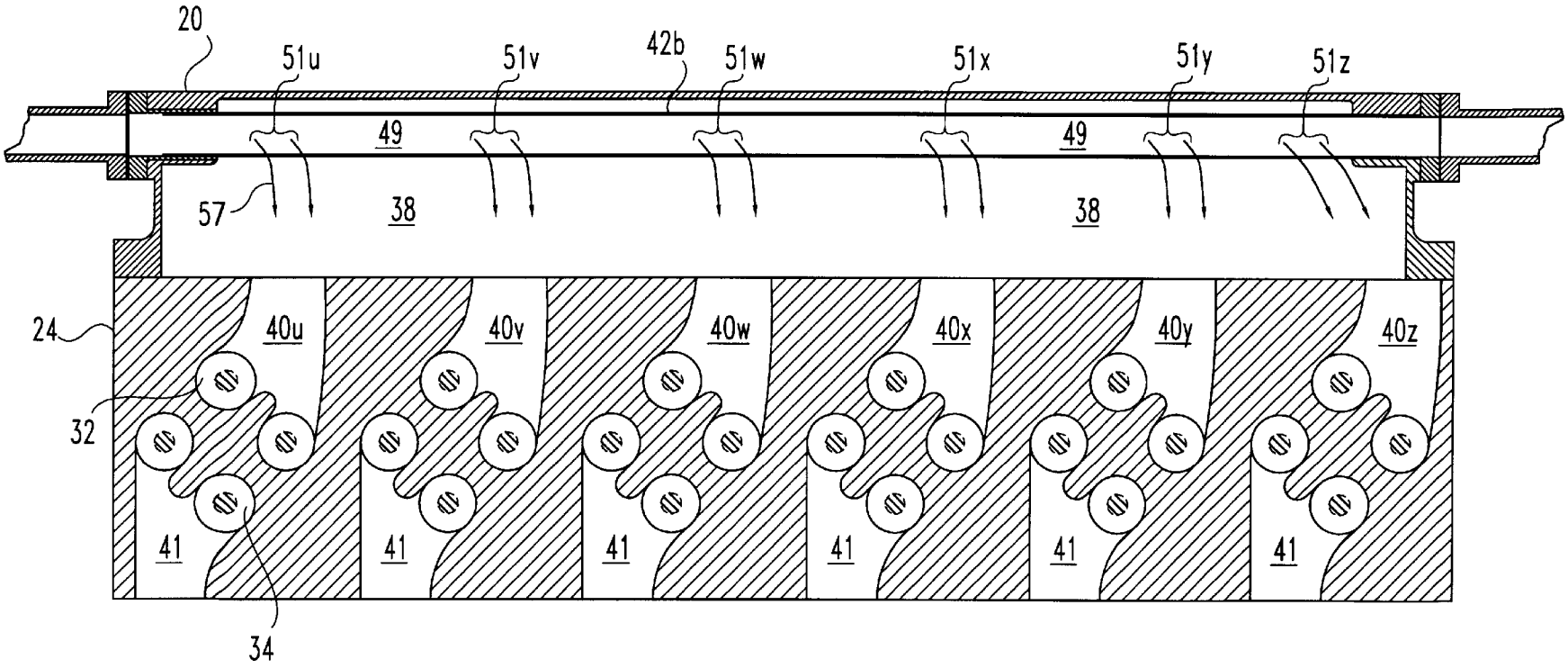
FIG. 7B is a cross sectional view of the FIG. 1 engine as taken along line 7—7 in FIG. 1, with alternative EGR manifold 42*b* installed.

FIGS. 7A and 7B are cross sectional views of FIG. 1 taken along line 7—7. FIG. 7A depicts alternative EGR manifold 42*a* inserted into intake manifold 20, and FIG. 7B depicts alternative EGR manifold 42*b* inserted into intake manifold 20. FIGS. 7A and 7B show the present invention as applied to an in-line 6-cylinder internal combustion engine with 2 intake valves and 2 exhaust valves per cylinder. The engine of FIG. 7A includes siamesed intake ports 40*a–c*, whereas the engine of FIG. 7B includes separate intake ports 40*u–z* for each cylinder. One skilled in the art will appreciate that the present invention is also applicable to engines with a different number of cylinders or valves per cylinder. Also, the present invention is applicable to engines other than in-line engines, including for example V-type engines.

EGR manifold 42*a* in FIG. 7A includes an arrangement of EGR delivery holes 50 in groupings 51*a*, 51*b*, and 51*c*. These groupings 51*a*, 51*b*, and 51*c* are arranged to flow predetermined proportions of exhaust gas into intake ports 40*a*, 40*b*, and 40*c*. Each grouping includes a number of delivery holes 50 equal to or greater than the number of intake valves 32 at the respective intake port.

EGR manifold 42*b* in FIG. 7B includes an arrangement of EGR delivery holes 50 in groupings 51*u*, 51*v*, 51*w*, 51*x*, 51*y*, and 51*z*. These groupings 51*u*, 51*v*, 51*w*, 51*x*, 51*y*, and 51*z* are arranged to flow predetermined proportions of exhaust gas into intake ports 40*u*, 40*v*, 40*w*, 40*x*, 40*y*, and 40*z*. Each grouping includes a number of delivery holes 50 equal to or greater than the number of intake valves 32 at the respective intake port.

One of ordinary skill in the art will recognize that the predetermined flow of exhaust gas into intake ports 40 may be achieved with either less than or more than one hole 50 per intake valve. In addition, delivery holes 50 in EGR manifolds 42, 42*a*, or 42*b* need not be equidistant or equal in size. One skilled in the art will appreciate that knowledge of the optimum placement and size of delivery holes 50 or groupings 51 may require use of computational fluid dynamics (CFD) or routine experimentation. For example, it may be advantageous to place some of delivery holes 50 near areas of high local air velocity within flowpath 38 so as to expose hole 50 to low static pressure. One skilled in the art will also recognize that alternative manifolds 42*a* and 42*b* are compatible with the single source concept of alternative manifold 42'.

Figure 8:
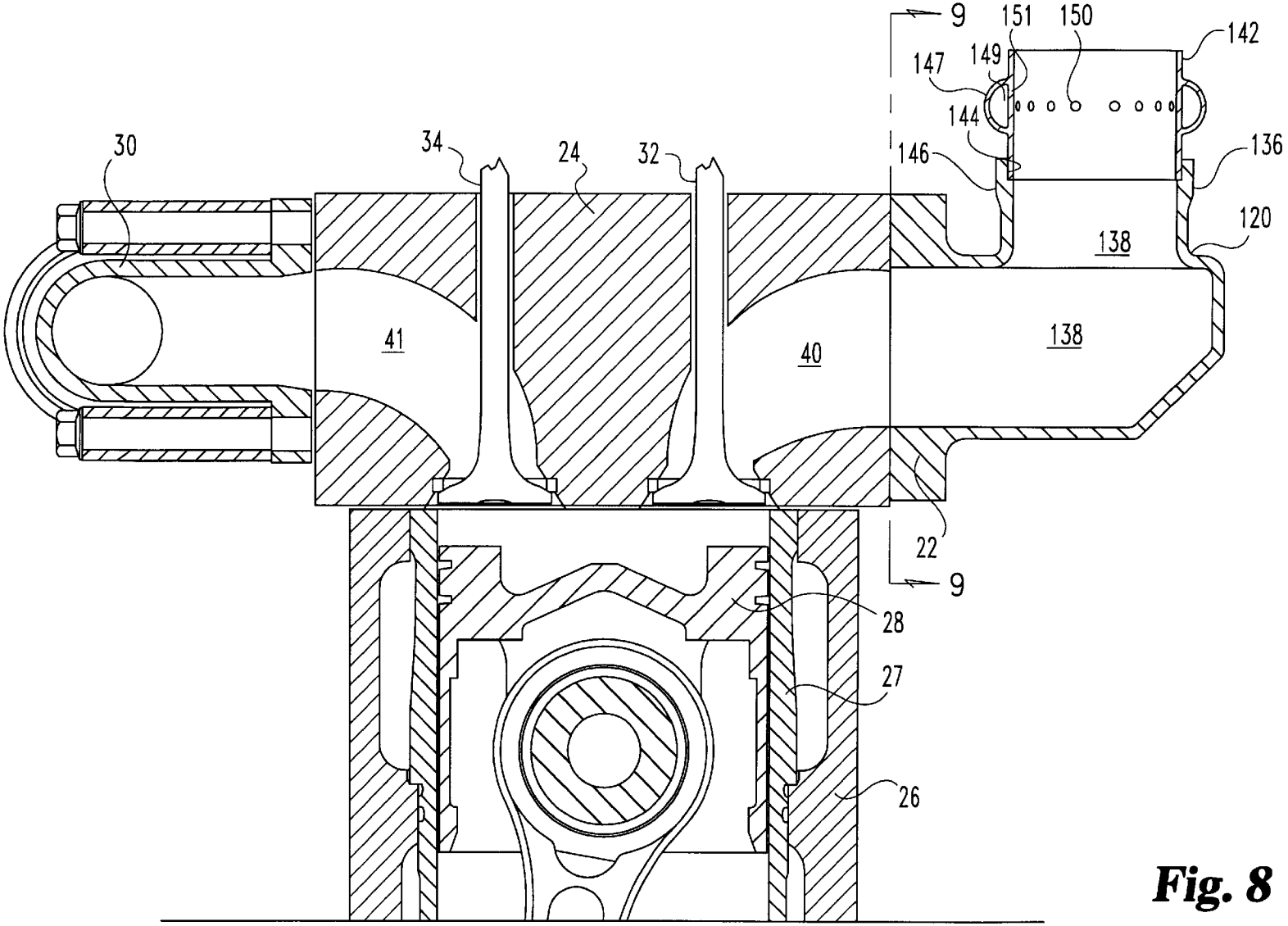
FIG. 8 is a cross sectional front elevational view of an internal combustion engine incorporating a second embodiment of the present invention.

FIG. 8 is a cross sectional front elevational view of an internal combustion engine incorporating a second embodiment of the present invention. It is understood that usage of numbers that are the same as numbers used to describe the first embodiment denote a feature or element that is substantially the same. A separable exhaust gas recirculation manifold 142 is shown accommodated within support boss 146 of intake manifold 120. Support 146 defines a cavity 144 proximate to intake manifold inlet 136. Exhaust gas recirculation manifold 142 is received within cavity 144 of support 146. Recirculation manifold 142, inlet 136, and boss 146 are generally round in shape.

Exhaust gas recirculation manifold 142 include an outer wall 147 and an inner wall 151 which form between them annular volume 149. Exhaust gas is provided from exhaust manifold 30 to volume 149. This exhaust gas is recirculated into flowpath 138 of intake manifold 120 through a plurality of delivery holes 150 in wall 151.

Figure 9:
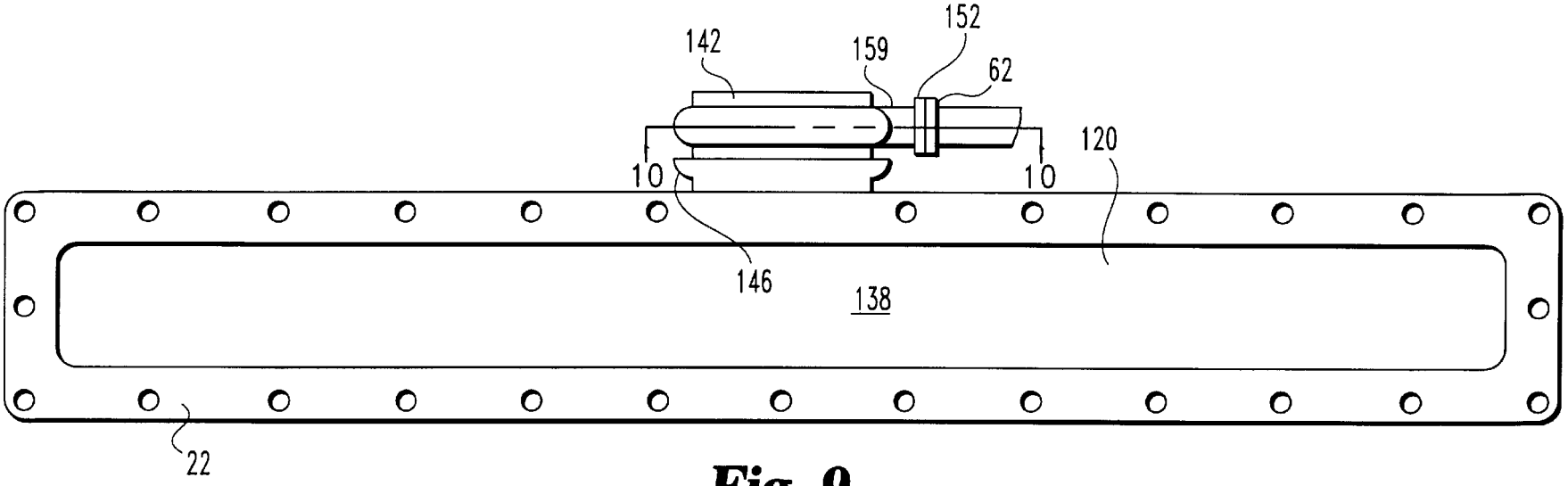
FIG. 9 is a side elevational view of the FIG. 8 engine including an EGR manifold as taken along line 9—9 in FIG. 8.

FIG. 9 is a side elevational view of the FIG. 8 engine including an EGR manifold as taken along line 9—9 in FIG. 8. Recirculation manifold 142 is retained atop intake manifold 120 in a manner not shown but obvious to those of ordinary skill in the art. For example, a bolted or clamped retention method can be used. Recirculation manifold 142 incorporates a flange fitting 152 which is in fluid communication with annular volume 149 through tubular connection 159. A first supply of exhaust gas via conduit 62 is provided to inlet 154 of flange 152.

Figure 10:
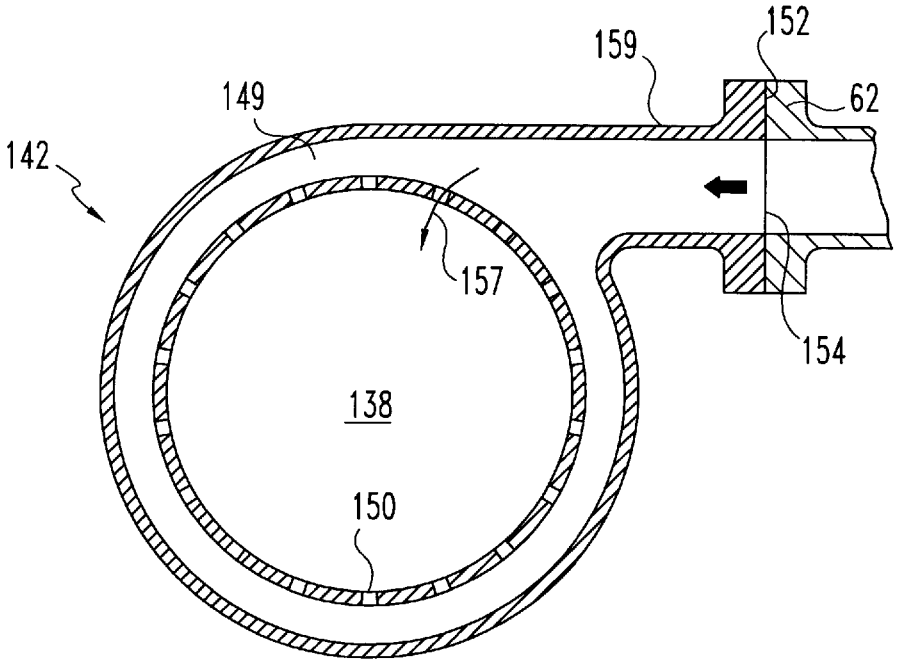
FIG. 10 is a cross sectional view of the FIG. 9 EGR manifold as taken along line 10—10.

FIG. 10 is a cross sectional view of the FIG. 9 EGR manifold as taken along line 10—10. Exhaust gas supply conduit 62 is in fluid communication with inlet 154 of EGR manifold 142. Recirculated exhaust gas flows into inlet 154, into annular volume 149, and into flowpath 138 through delivery holes 150 as depicted generally by arrow 157.

Figure 11:
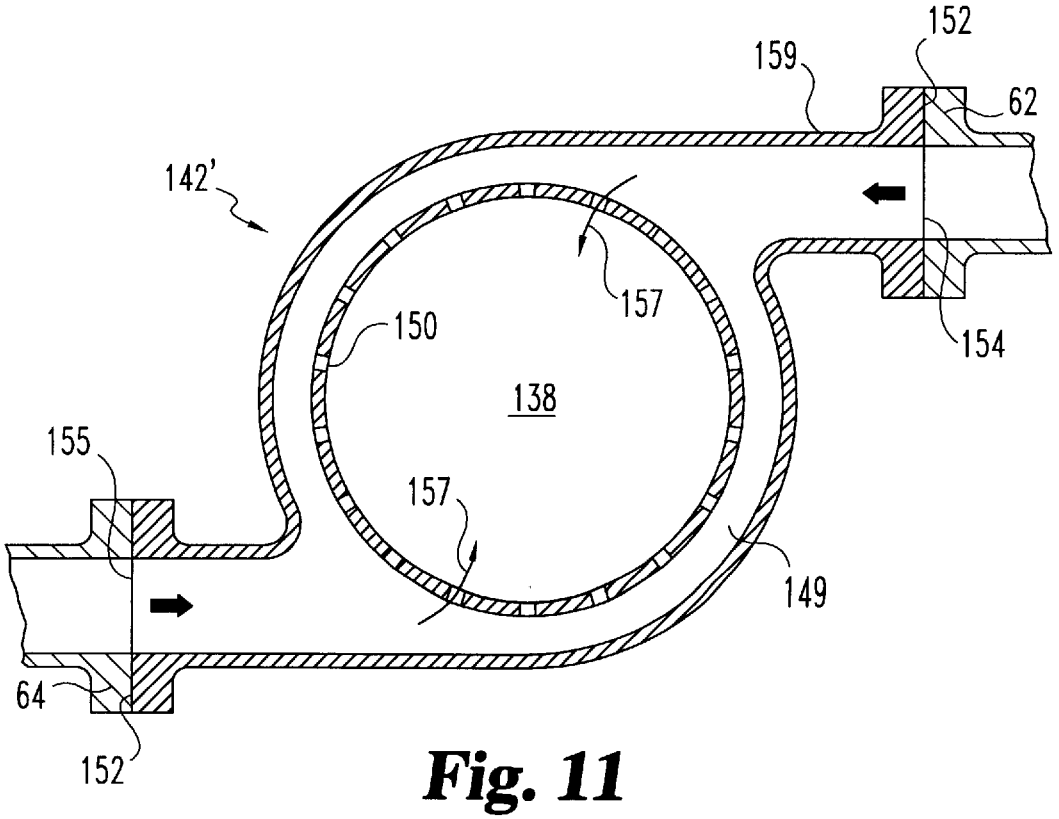
FIG. 11 is a view similar to that of FIG. 10 showing an alternate EGR manifold.

FIG. 11 is a view similar to that of FIG. 10 showing an alternate EGR manifold. EGR manifold 142' is similar to manifold 142, except that manifold 142' also incorporates a second inlet 155 which is in fluid communication with second supply of exhaust gas via conduit 64. Recirculation manifold 142 is suitable for internal combustion engines using two different supplies of exhaust gas for recirculation into flowpath 138.

Delivery holes 150 are sized and located to provide a predetermined flow of exhaust gas into each intake port 40. One of ordinary skill in the art will recognize that the predetermined flow of exhaust gas into intake ports 40 may be achieved with an arrangement of delivery holes 150 that are not equidistant or equal in size. One skilled in the art will appreciate that knowledge of the optimum placement and size of delivery holes 150 in wall 151 may require use of computational fluid dynamics (CFD) or routine experimentation. In addition, delivery holes 50 and 150 can be non circular openings. It may also be helpful to incorporate a feature that promotes mixing of the recirculated exhaust gas and the inducted air, such as a boundary layer trip downstream of holes 150. One of ordinary skill in the art will also recognize that EGR manifolds 142 and 142' are applicable to a variety of types of internal combustion engines, including for example both in-line and V-type.

The present invention includes apparatus and methods for providing a predetermined distribution of recirculated exhaust gas to the inducted air of an internal combustion engine by a separable EGR manifold integrated into the intake manifold. It is well known in the art that providing recirculated exhaust gas to the inducted air results in lower peak combustion temperature, with a subsequent reduction in the formation of nitrous oxides during combustion. It is also appreciated in the art that it may be advantageous under some conditions to cool the recirculated exhaust gas prior to mixing with the inducted air. However, the present invention includes the discovery that it is difficult to achieve good mixing of cooled recirculated exhaust gas with the charge of inducted air in the intake manifold. For example, if the cooled recirculated exhaust gas is introduced to the intake manifold at a single location, the cooled exhaust gas shows an affinity for the walls of the intake manifold and tends to stay near the walls. In this example of single point introduction of cooled exhaust gas there is a maldistribution of the recirculated exhaust gas among the various cylinders, with some cylinders receiving other than the predetermined percentage of exhaust gas.

This problem of maldistribution may be worse in a diesel engine as compared to a spark ignition engine. A diesel engine typically has a higher pressure in the intake manifold than a spark ignition engine because the diesel engine operates in an unthrottled state. Because the recirculated exhaust gas flows as a result of a driving pressure differential between the recirculation manifold and the intake manifold, the higher intake manifold pressures of a diesel engine decreases this driving pressure differential and cause the recirculated exhaust gas to exit the recirculation manifold at lower velocities. The low velocity of the recirculated exhaust gas does not adequately discourage the affinity of the cooled exhaust gas for the walls of the intake manifold.

The problem of a low driving pressure differential between the recirculation manifold and the intake manifold is further heightened by the use of a turbocharger. A turbocharger increases the pressure within the intake manifold and can result in a reversal of the driving pressure differential, such that the intake charge could flow into the recirculation manifold. The driving pressure differential can be restored such that recirculated exhaust gas flows into the intake manifold by the use of a separate pump to increase the pressure of the recirculated exhaust gas or by the use of a smaller turbine for the turbocharger, such that the pressure in exhaust manifold 30 increases. The present invention is useful with both an exhaust gas pump and also with a smaller turbine for a turbocharger.

It is further appreciated within the art that cooling of recirculated exhaust gas results in creation of a corrosive medium. For example, water vapor within the exhaust gas condenses to liquid water if cooled sufficiently. This liquid water combines with other gases in the exhaust gas, such as sulphur dioxide, to form corrosive compounds such as sulphuric acid. The exhaust gas recirculation manifold should be capable of operation after repeated exposure to these corrosive mixtures. With the present invention, it is preferable that EGR manifolds 42, 42', 42*a*, 42*b*, 142, and 142' be fabricated from a relatively inert material, such as a corrosion resistant stainless steel.

Construction of EGR manifold 42, or any of its' alternatives, may be constructed from a corrosion resistant material with a relatively high melting point permits economical fabrication of the EGR manifold within the intake manifold. For example, body 48 can be fabricated from tubing stock or rolled from sheet stock. Flange 52 can be welded or otherwise suitably attached to body 48. Intake manifold 20 is typically fabricated from a castable, lower melting point material, such as an organic compound or aluminum. Since the melting point of such intake manifold materials is sufficiently lower than the melting point of the EGR manifold material, the finished assembly 42 can optionally be inserted into the casting tool used to cast intake manifold 20. Intake manifold 20 can be cast around the finished EGR manifold 42. A suitable material for EGR manifolds 42 and its alternatives is 304 stainless steel, as an example only. Examples of suitable materials for intake manifold 20 and 120 include A380 aluminum, AZ91E or AZ91D magnesium, 6/6 nylon, and Amodel A-1133.

In addition, it is preferable that the recirculation manifold be removable and separable from the internal combustion engine with minimal removal of other components. The present invention contemplates removal of the exhaust gas recirculation manifolds 42 and 142 and their alternatives without the need to remove the intake manifold from the engine, such as for cleaning purposes.

The present invention is useful with other components within the exhaust gas recirculation system. For example, a heat exchanger cooled by air, water, or other means, can be used to cool the exhaust gas prior to introduction into the recirculation manifolds. The linear shape of dual inlet manifold 42 provides a benefit to packaging of the EGR manifold and heat exchanger under the hood of a vehicle, particularly if the heat exchanger has a linear shape. It is understood that the present invention does not require the use of cooled exhaust gas.

Also, the present invention is useful with one or more valves that regulate the supply of recirculated exhaust gas. Having such valves relatively close to the recirculation manifolds, combined with the relatively low internal volume of recirculation manifolds 42 and 142 and their alternatives, can result in improved transient response of the engine. It is known in the art that driveability of an internal combustion engine, especially during quick changes in load, can be improved by quick turnoff and purging of the EGR manifold. The present invention is useful with a quick responding exhaust gas recirculation control system by incorporating relatively low internal volume 49 and annular volume 149 within EGR manifolds 42 and its' alternatives, and manifold 142 and its' alternatives, respectively. It is preferrable, but not necessary, if internal volumes 49 and 149 are less than about twice the volume inducted by a piston 28 stroking within cylinder 27.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for an internal combustion engine with a plurality of cylinders, intake ports, and intake valves, comprising:

an intake manifold attached to the engine, said intake manifold having a cavity for receiving an exhaust gas recirculation manifold;

a removable exhaust gas recirculation manifold insertable in the cavity of said intake manifold, said exhaust gas recirculation manifold defining a plurality of outlet holes for delivery of exhaust gas to said intake manifold;

wherein said exhaust gas recirculation manifold is removable from said intake manifold without removing said intake manifold from the engine;

a first supply of exhaust gas at a first temperature; and a second supply of exhaust gas at a second temperature, the second temperature being at least 100 degrees Fahrenheit cooler than the first temperature;

wherein said exhaust gas recirculation manifold has a first inlet for said first supply and a second inlet for said second supply.

2. The apparatus of claim 1 wherein said exhaust gas recirculation manifold has a plurality of inlets for exhaust gas.

3. The apparatus of claim 1 wherein said exhaust gas recirculation manifold defines a number of outlet holes equal to or greater than the number of intake valves.

4. The apparatus of claim 1 wherein said exhaust gas recirculation manifold defines a number of outlet holes equal to or greater than the number of cylinders.

5. The apparatus of claim 1 wherein said exhaust gas recirculation manifold defines a number of outlet holes equal to or greater than the number of intake ports.

6. The apparatus of claim 1 wherein said exhaust gas recirculation manifold is generally linear in shape.

7. The apparatus of claim 1 wherein said exhaust gas recirculation manifold is generally round in shape, said exhaust gas recirculation manifold having an inner wall, an outer wall, and an annulus therebetween, the annulus surrounding the inner wall.

8. An apparatus for an internal combustion engine having an intake manifold and a plurality of cylinders, intake ports, and intake valves, comprising:

a separable body defining an internal passageway and a plurality of delivery holes, said internal passageway being in fluid communication with said plurality of delivery holes, said body being insertable in the inlet manifold, said delivery holes providing flow of exhaust gas to the cylinders;

a first supply of exhaust gas at a first temperature; and a second supply of exhaust gas at a second temperature, the second temperature being at least 100 degrees Fahrenheit cooler than the first temperature;

wherein said body has a first inlet for said first supply and a second inlet for said second supply.

9. The apparatus of claim 8 wherein said body has a plurality of inlets for exhaust gas.

10. The apparatus of claim 8 wherein said body is generally linear in shape.

11. The apparatus of claim 8 wherein said body is generally round in shape, said body having an inner wall, an outer wall, an annulus therebetween, the annulus surrounding the inner wall, said inner wall including said plurality of delivery holes.

12. The apparatus of claim 8 wherein said exhaust gas recirculation manifold defines a number of delivery holes equal to or greater than the number of intake valves.

13. The apparatus of claim 8 wherein said exhaust gas recirculation manifold defines a number of delivery holes equal to or greater than the number of cylinders.

14. The apparatus of claim 8 wherein said exhaust gas recirculation manifold defines a number of delivery holes equal to or greater than the number of intake ports.

15. An apparatus for recirculating exhaust gas in an internal combustion engine having a plurality of cylinders and intake valves, comprising:

a first supply of exhaust gas at a first temperature;

a second supply of exhaust gas at a second temperature, the second temperature being at least 100 degrees Fahrenheit cooler than the first temperature;

an intake manifold capable of receiving an exhaust gas recirculation manifold; and an exhaust gas recirculation manifold received by said intake manifold, said exhaust gas recirculation manifold having a first inlet in fluid communication with said first supply and a second inlet in fluid communication with said second supply, said exhaust gas recirculation manifold defining at least two outlet holes.

16. The apparatus of claim 15 wherein said exhaust gas recirculation manifold defines a number of outlet holes equal to or greater than the number of intake valves.

17. The apparatus of claim 15 wherein said exhaust gas recirculation manifold defines a number of outlet holes equal to or greater than the number of cylinders.

18. The apparatus of claim 15 wherein said exhaust gas recirculation manifold is generally linear in shape.

19. The apparatus of claim 15 wherein said exhaust gas recirculation manifold is generally round in shape, said exhaust gas recirculation manifold having an inner wall, an outer wall, and an annulus therebetween, the annulus surrounding the inner wall.

20. An apparatus for recirculating exhaust gas in an internal combustion engine having a plurality of cylinders and intake valves, comprising:

an intake manifold having a cavity for receiving an exhaust gas recirculation manifold; and a removable exhaust gas recirculation manifold insertable in the cavity of said intake manifold, said exhaust gas recirculation manifold having a plurality of inlets for exhaust gas, said exhaust gas recirculation manifold defining an outlet hole for delivery of recirculated exhaust gas into said intake manifold.

21. The apparatus of claim 20 which further comprises:

a first supply of exhaust gas at a first temperature; and a second supply of exhaust gas at a second temperature, the second temperature being at least 100 degrees Fahrenheit cooler than the first temperature;

wherein said exhaust gas recirculation manifold has a first inlet for said first supply and a second inlet for said second supply.

22. The apparatus of claim 20 wherein said exhaust gas recirculation manifold defines at least two outlet holes.

23. The apparatus of claim 20 wherein said exhaust gas recirculation manifold defines a number of outlet holes equal to or greater than the number of intake valves.

24. The apparatus of claim 20 wherein said exhaust gas recirculation manifold defines a number of outlet holes equal to or greater than the number of cylinders.

25. The apparatus of claim 20 wherein said exhaust gas recirculation manifold is generally linear in shape.

26. The apparatus of claim 1 wherein said exhaust gas recirculation manifold is generally round in shape, said exhaust gas recirculation manifold having an inner wall, an outer wall, and an annulus therebetween, the annulus surrounding the inner wall.

27. A method for recirculating exhaust gas to the intake manifold of an internal combustion engine, comprising:

fabricating an exhaust gas recirculation manifold;

inserting the exhaust gas recirculation manifold into a tool used for molding or casting an intake manifold; and casting at least a portion of the intake manifold around a portion of the exhaust gas recirculation manifold.

28. The method of claim 27 which further comprises:

providing a first supply of exhaust gas to the exhaust gas recirculation manifold; and flowing exhaust gas from the first supply into the intake manifold.

29. The method of claim 28 which further comprises:

providing a second supply of exhaust gas to the exhaust gas recirculation manifold that is at least 100 degrees Fahrenheit cooler than the first supply; and flowing exhaust gas from either the first supply or the second supply into the intake manifold.

30. The method of claim 27 which further comprises:

installing the intake manifold containing the portion of the exhaust gas recirculation manifold onto an internal combustion engine after said casting; and removing the exhaust gas recirculation manifold from the intake manifold without removing the intake manifold from the engine.

31. The method of claim 27 wherein the exhaust gas recirculation manifold is fabricated from a first material with a first melting point, the intake manifold is cast from a second material with a second melting point, and the first melting point is higher than the second melting point.

32. The apparatus of claim 15 which further comprises a heat exchanger for cooling the second supply of exhaust gas.

33. The apparatus of claim 2 which further comprises a heat exchanger for cooling the second supply of exhaust gas.

34. The apparatus of claim 9 which further comprises a heat exchanger for cooling the second supply of exhaust gas.

35. The apparatus of claim 21 which further comprises a heat exchanger for cooling the second supply of exhaust gas.

* * * * *

UNITED STATES PATENT AND TRADEMARK OFFICE

CERTIFICATE OF CORRECTION

PATENT NO. : 5,957,116
DATED : September 28, 1999
INVENTOR(S) : Glen T. Haegele, Paul R. Miller, L.K. Hwang It is certified that error appears in the above-identified patent and that said Letters Patent is hereby corrected as shown below:

Please insert the following under "References Cited" on the Title page:

| | | | |
|---|---|---|---|
| 2,034,144 | 3/1936 | M.A. Lauret | 123/139 |
| 3,717,130 | 2/1973 | Thornburgh | 123/52MV |
| 3,717,131 | 2/1973 | Chana et al. | 123/52MV |
| 3,892,026 | 7/1975 | Thornburgh | 29/156.4R |
| 4,072,133 | 2/1978 | McWhirter | 123/52MV |
| 4,276,865 | 7/1981 | Hamai | 123/569 |
| 4,609,009 | 9/1986 | Tisone | 137/561A |
| 4,870,941 | 10/1989 | Hisatomi | 123/571 |
| 5,329,912 | 7/1994 | Matsumoto et al. | 123/568 |
| 5,425,347 | 6/1995 | Zinke, II | 123/568 |
| 5,427,080 | 6/1995 | Maeda et al. | 123/568 |
| 5,474,102 | 12/1995 | Lopez | 137/271 |
| 5,490,488 | 2/1996 | Aversa et al. | 123/570 |
| 5,492,104 | 2/1996 | Elder et al. | 123/568 |
| 5,542,711 | 8/1996 | Vaudry | 285/41 |
| 5,609,144 | 3/1997 | Seizew et al. | 123/568 |

DE 3106822 2/1981 Schneekloth, H.

1995 Cadillac Service Manual, GMP/95-EK-1, Section 6E-C, pp. 1-18

Signed and Sealed this

Twentieth Day of November, 2001

*Attest:*

Nicholas P. Godici

*Attesting Officer*

NICHOLAS P. GODICI
*Acting Director of the United States Patent and Trademark Office*